US007849644B2

(12) United States Patent
Melesky

(10) Patent No.: US 7,849,644 B2
(45) Date of Patent: Dec. 14, 2010

(54) SYSTEM FOR INSULATING ATTIC OPENINGS

(76) Inventor: James B. Melesky, 1345 Shadow Oak Dr., Malvern, PA (US) 19355

( * ) Notice: Subject to any disclaimer, the term of this patent is extended or adjusted under 35 U.S.C. 154(b) by 471 days.

(21) Appl. No.: 11/383,744

(22) Filed: May 16, 2006

(65) Prior Publication Data

US 2006/0258284 A1 Nov. 16, 2006

Related U.S. Application Data

(60) Provisional application No. 60/681,309, filed on May 16, 2005.

(51) Int. Cl.
*E06B 3/26* (2006.01)
*E06B 3/32* (2006.01)

(52) U.S. Cl. ..... 52/202; 52/404.1; 49/61; 49/463

(58) Field of Classification Search ..... 52/205, 52/317, 404.4, 19, 200, 407.4, 202; 49/402, 49/464, 465, 463, 466, 61–64, 125, 401
See application file for complete search history.

(56) References Cited

U.S. PATENT DOCUMENTS

| | | | | | |
|---|---|---|---|---|---|
| 33,592 | A | | 10/1861 | McIlwain | |
| 541,987 | A | | 7/1895 | Whiteside | |
| 794,661 | A | | 7/1905 | Clark | |
| 947,063 | A | * | 1/1910 | Hickman | 49/142 |
| 1,000,807 | A | * | 8/1911 | Henry | 49/365 |
| 1,248,359 | A | * | 11/1917 | McNulty | 49/465 |
| 1,380,831 | A | * | 6/1921 | Nelson et al. | 49/464 |
| 1,536,587 | A | * | 5/1925 | Johnson | 49/402 |
| 1,630,100 | A | * | 5/1927 | Whittier | 52/479 |
| 1,776,168 | A | * | 9/1930 | Sweeley et al. | 105/377.07 |
| 1,936,631 | A | * | 11/1933 | Lane | 49/61 |
| 1,958,487 | A | | 5/1934 | Moran | |
| 1,989,391 | A | * | 1/1935 | Whittier | 160/32 |
| 2,114,880 | A | * | 4/1938 | King | 220/592.08 |
| 2,127,111 | A | * | 8/1938 | Gaenzle | 52/404.4 |
| 2,172,373 | A | * | 9/1939 | Flagstad | 49/464 |
| 2,190,954 | A | * | 2/1940 | Stickel | 220/592.06 |
| 2,194,230 | A | * | 3/1940 | Lewis | 49/464 |
| 2,210,580 | A | * | 8/1940 | Gersten | 446/480 |
| 2,271,355 | A | * | 1/1942 | Sweet | 52/404.4 |

(Continued)

FOREIGN PATENT DOCUMENTS

| | | | |
|---|---|---|---|
| EP | 0047996 | * | 3/1982 |

*Primary Examiner*—Robert J Canfield
*Assistant Examiner*—Brent W Herring
(74) *Attorney, Agent, or Firm*—Lewis, Rice & Fingersh, L.C.

(57) ABSTRACT

A cover for closing an access opening that leads to an infrequently used space within a building, such as an attic, provides thermal and acoustic insulation at the access opening. The cover may be in one or two portions, including a closure alone or a closure and a frame having an aperture that can be closed by engagement between the closure and the frame. When the cover is used alone it engages a frame or a wall circumscribing the access opening. The cover is sized and shaped to close a stairwell, or the opening at one end of a stairway, or an opening in a generally vertical wall that is not necessarily associated with a stairway. The closure and frame are each made of one or more components.

16 Claims, 12 Drawing Sheets

U.S. PATENT DOCUMENTS 2,275,128 A * 3/1942 Campbell ..... 16/232
2,294,046 A * 8/1942 Cser ..... 126/548
2,345,394 A * 3/1944 Hogan ..... 114/203
2,511,108 A * 6/1950 Hansen ..... 160/90
2,519,132 A * 8/1950 Hansen ..... 160/107
2,747,202 A * 5/1956 Driver ..... 5/2.1
2,825,940 A * 3/1958 Kurtz ..... 49/366
2,862,367 A 12/1958 Silverstein et al.
2,908,947 A * 10/1959 Meacham ..... 49/401
3,062,278 A * 11/1962 Indorante ..... 160/92
3,120,032 A * 2/1964 Burnette ..... 49/395
3,243,855 A * 4/1966 Houvener et al. ..... 52/455
3,252,258 A * 5/1966 Blickman et al. ..... 52/582.1
3,356,183 A 12/1967 Shell
3,361,286 A * 1/1968 Alleaume ..... 220/560.05
3,397,490 A * 8/1968 Carlson ..... 49/482.1
3,738,070 A 6/1973 Yarbrough
3,797,172 A * 3/1974 Cannon ..... 49/463
3,807,194 A 4/1974 Bond
3,807,528 A 4/1974 Frank
3,855,741 A 12/1974 Semon
3,896,595 A 7/1975 Anghinetti et al.
3,938,284 A 2/1976 Broadbent et al.
3,967,671 A * 7/1976 Stanley et al. ..... 160/232
4,048,926 A 9/1977 Brush, Jr. et al.
4,065,336 A 12/1977 Conklin
4,084,570 A * 4/1978 Rule et al. ..... 126/546
4,099,353 A 7/1978 Blunt
4,118,894 A * 10/1978 Kennedy et al. ..... 49/402
4,151,894 A 5/1979 Edwards
4,180,142 A 12/1979 Sevillano et al.
4,187,647 A 2/1980 Hall
4,197,031 A 4/1980 Hild
4,203,686 A 5/1980 Bowman
4,207,706 A * 6/1980 Haines ..... 49/141
4,281,743 A 8/1981 Fuller
4,299,059 A 11/1981 Smith
4,302,126 A 11/1981 Fier
4,312,423 A 1/1982 Helbig
4,344,505 A 8/1982 Waters et al.
4,361,613 A 11/1982 Bogner et al.
4,370,934 A 2/1983 Häussler
4,440,407 A 4/1984 Gagas
4,468,886 A * 9/1984 Tew ..... 49/141
4,469,087 A 9/1984 Cameron
4,483,101 A * 11/1984 Berzina ..... 49/380
4,502,368 A 3/1985 Hempel
4,541,508 A 9/1985 Lundh
4,550,534 A 11/1985 Mariano et al.
4,563,845 A * 1/1986 Stipe ..... 52/202
4,567,074 A 1/1986 Litaker
4,591,022 A 5/1986 Sciambi et al.
4,658,555 A 4/1987 Steiner
4,823,530 A * 4/1989 Haring ..... 52/317
4,832,153 A 5/1989 Daw et al.
4,891,921 A * 1/1990 Governale ..... 52/207
4,925,509 A 5/1990 Tippmann
4,928,441 A 5/1990 Daley
5,007,226 A * 4/1991 Nelson ..... 52/784.15
5,067,278 A * 11/1991 Lyons ..... 49/463
5,158,043 A * 10/1992 Emsbo ..... 122/498
5,161,329 A * 11/1992 Brown ..... 49/380
5,172,519 A * 12/1992 Cooper ..... 49/400
5,271,198 A 12/1993 Freeman
5,301,655 A * 4/1994 Licata ..... 126/547
5,361,552 A * 11/1994 Fulford ..... 52/455
5,475,955 A 12/1995 Dickinson
5,549,411 A 8/1996 Hawkins
5,623,795 A 4/1997 Padgett, Jr.
5,628,151 A 5/1997 Monat
5,628,158 A 5/1997 Porter
5,735,086 A 4/1998 Fordahl
5,743,057 A * 4/1998 Martin ..... 52/457
5,791,098 A * 8/1998 Thomas ..... 52/169.6
5,815,996 A * 10/1998 Granger ..... 52/202
5,860,465 A * 1/1999 Eastridge et al. ..... 160/113
5,979,128 A 11/1999 Parsons
6,006,944 A 12/1999 Machledt
6,014,841 A 1/2000 McCoy, Jr. et al.
6,151,848 A * 11/2000 Hunter ..... 52/205
6,468,585 B2 10/2002 Tippmann et al.
6,578,327 B1 6/2003 Hackbarth et al.
6,601,352 B1 * 8/2003 Obermeyer et al. ..... 52/202
6,651,391 B2 11/2003 Nale
6,682,258 B2 1/2004 McNeely
6,701,676 B1 3/2004 Kompelien
7,028,431 B2 * 4/2006 Tlemcani et al. ..... 49/8
2006/0064935 A1 * 3/2006 Smith et al. ..... 49/381
2007/0220826 A1 * 9/2007 Peng et al. ..... 52/796.12

* cited by examiner

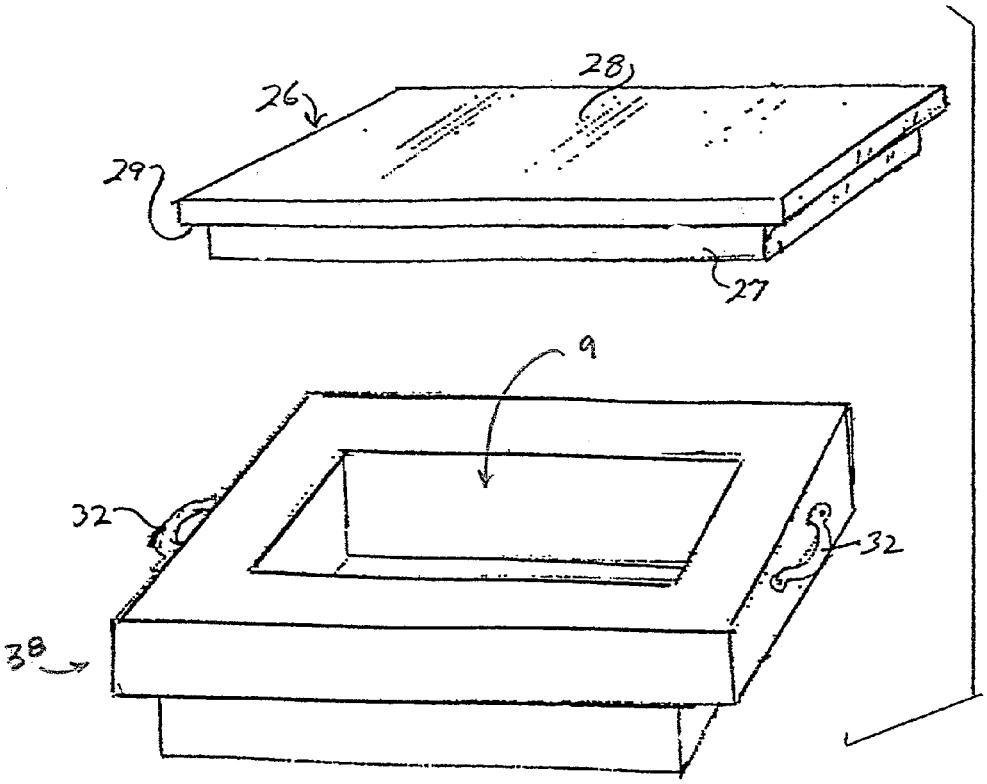
FIG.3
FIG.4
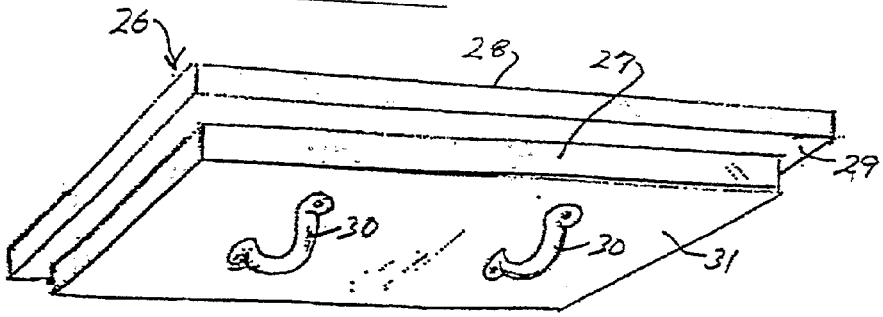

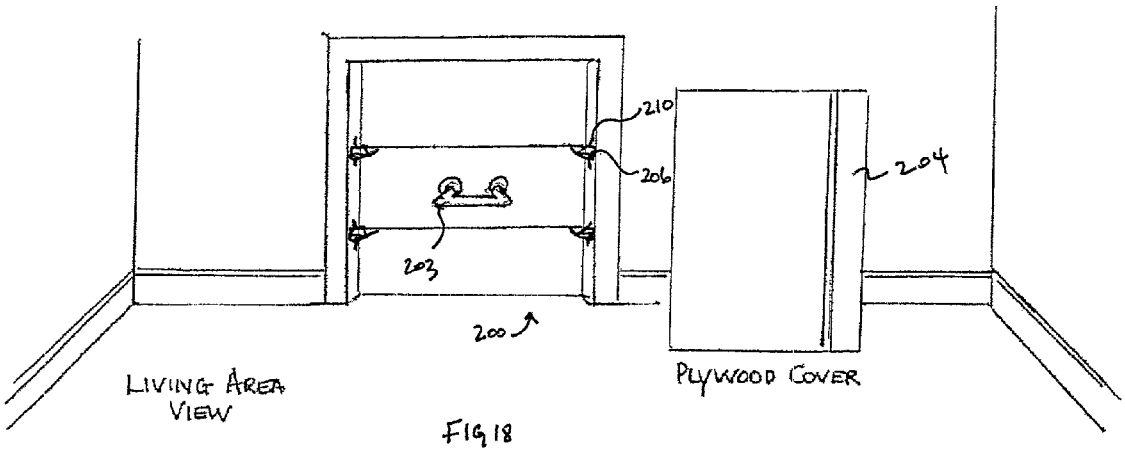
FIG 18
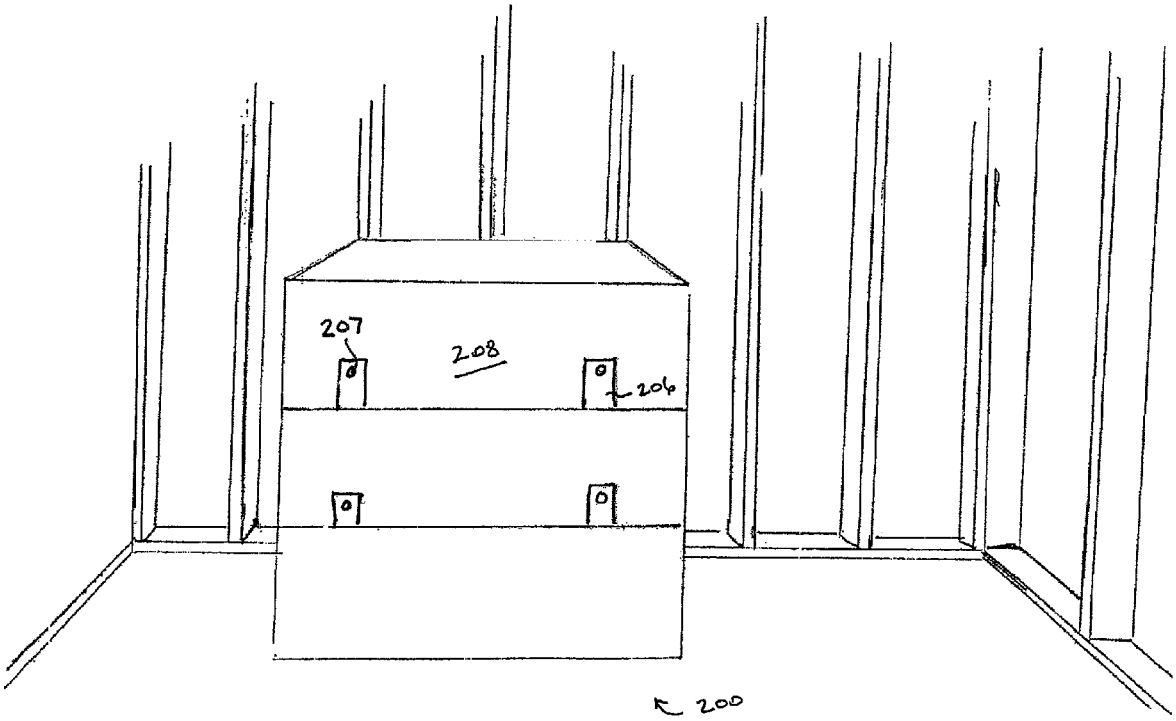
ATTIC VIEW FIG. 19

SYSTEM FOR INSULATING ATTIC OPENINGS

REFERENCE TO RELATED APPLICATIONS

This application claims priority to and the benefit of U.S. Provisional Application Ser. No. 60/681,309, filed May 16, 2005, the entire disclosure of which is incorporated herein by this reference.

BACKGROUND OF THE INVENTION

1. Field of the Invention

This invention relates to covers used in wall or ceiling openings in buildings to prevent loss of heat during cold weather and loss of cool air during hot weather that is otherwise caused by a poorly insulating door that is used to close the opening.

2. Description of the Related Art

Rather than an in-ceiling attic opening, some homes have walk-through or crawl-through openings, some with doors (usually mounted in a generally vertical orientation), for access to an attic space. When such an opening has a door, it may be an ordinary, full-sized door, mounted on hinges within a door frame, as are mounted most interior household doors. In other situations such a door may be as simple as a piece of plywood or other material that has been cut to fit into a wall opening and which may be held in the opening by a latch, but often is not mounted on hinges. Often such a door, whether full-sized or not, has no additional insulation within or about it, including not having any sort of weather-stripping around its edges, where it contacts the door frame or the wall. Such a door usually provides a substantial breach to the otherwise encompassing insulation of the home or other building. A plywood door typically has an insulating R-value of 0.5 or less, while commonly the remainder of the attic has insulation with an R-value significantly greater.

There have been a number of inventions to date that have addressed this problem, though primarily in connection with in-ceiling openings. The inventions primarily address the problem with two main approaches, one- and two-piece covers.

There are a number of one-piece covers. U.S. Pat. No. 4,299,059 discloses a ceiling door that is insulated and to which an attic ladder is attached. U.S. Pat. No. 4,151,894 discloses a one-piece cover for an attic opening that fits over the attic door. It is double walled and able to contain a layer of insulation. U.S. Pat. No. 4,281,743 similarly provides a one-piece cover for an attic opening that fits over the attic door. This cover, however, is a shell, comprised of multiple pieces that need to be assembled in a tongue and groove design into which insulating panels are inserted. U.S. Pat. No. 5,475,955 discloses a two-piece shell that is able to contain insulation. U.S. Pat. No. 4,832,153 is also a one-piece cover for an attic opening. This cover consists of detachable components that can be stored or attached with assembly components to serve as an insulating cover. U.S. Pat. No. 4,928,441 discloses an inverted tub shaped cover that is hinged to an attic floor. U.S. Pat. No. 5,271,198 discloses a compartmentalized plastic or fiberboard shell with a moisture barrier insert that can accommodate insulation. U.S. Pat. No. 5,628,151 discloses a one-piece shell with multiple pockets that can hold insulation.

There have also been other two-piece covers. U.S. Pat. No. 4,344,505 discloses a stationary frame with a hinged door that opens to an upright position. The door and frame are made of insulated material and covered with wood furring for securing the hinges to the door and frame. The door merely rests on the frame. U.S. Pat. No. 4,591,022 discloses a frame and door, but the door is in three pieces. In order to open the door, it collapses in an accordion manner to gain access to the attic. The frame consists of components that are attached and secured to the attic floor with hinges.

U.S. Pat. No. 4,312,423 discloses an all in one approach for a ladder, insulating cap and packaging container.

With each patent, there are some consistent elements. Each patent referenced above is not in itself an insulating solution. Rather, it is a shell made of various materials into which one can insert insulation. Thereafter, each solution has distinguishing ways to affix the cover to the attic and open the cover to access the attic. The shells require some assembly.

SUMMARY OF THE INVENTION

The following is a summary of the invention, which should provide to the reader a basic understanding of some aspects of the invention. This summary is not intended to identify critical elements of the invention or in any way to delineate the scope of the invention. The sole purpose of this summary is to present in simplified text some aspects of the invention as a prelude to the more detailed description presented below.

An embodiment is a system for closing a passage to an attic within a building, the system comprising a permanent stairway leading to the attic; a door positioned at the lower end of the stairway for entrance to the stairway; an attic access opening at the upper end of the permanent stairway; a frame comprising an aperture portion and an extension portion; and a closure for closing the aperture of the frame, the closure being separable from the frame and comprising a protruding body portion and a flange portion; wherein when the cover comprising the frame having the aperture sealed by the closure is positioned in a covering relationship to the attic access opening, a barrier is created which substantially inhibits air and heat flow through the attic access opening. In such an embodiment, the aperture portion comprises an aperture of sufficient size to allow a person to pass therethrough; and a plurality of components attached together to create an integral frame having an uninterrupted length fully encompassing the aperture. Further, in such an embodiment, the extension portion comprises at least one component attached to the aperture portion, thereby expanding at least one spatial dimension of the aperture portion. In such an embodiment the protruding body portion has a proximal and distal end, and is sized and shaped to fit within a perimeter of the aperture when the protruding body portion is oriented with the distal end directed into the aperture. In such an embodiment, the flange portion extends generally laterally from the proximal end of the protruding body portion, and is sized and shaped to contact and thereby form a seal with the frame external to the aperture when the protruding body portion is oriented to fit within the aperture.

An embodiment has characteristics as just described, and the closure is connected to the frame only when the closure is engaged with the frame to form the seal. In an alternate embodiment, the closure comprises at least two separate components having cooperative surfaces with respect to each other, such that in order for the closure to seal with the frame, a component seal must be created between the components along the cooperative surfaces, which component seal significantly inhibits air and heat flow therethrough.

In an alternate embodiment, the system for closing a passage to an attic further comprises a stairwell featuring a walled shaft through which the permanent stairway passes; wherein the covering relationship between the frame engaged by the closure and the attic access opening is created when the frame engaged by the closure is positioned within the stairwell such that the frame contacts the stairway and the walls of the stairwell along an uninterrupted path that circumscribes an interior surface of the stairwell.

In an embodiment the frame is sized and shaped to allow it to rest on a floor within the attic in a generally surrounding relationship to the attic access opening. In an alternate embodiment, the frame is attached to the floor of the attic. In a still further embodiment, the frame includes a first flange portion that contacts the floor of the attic in a surrounding relationship to the attic access opening, and a second flange portion that depends into the attic access opening.

In an embodiment, the extension portion of the frame expands at least two spatial dimensions of the aperture portion of the frame. In an alternate embodiment, the extension portion is comprised of a plurality of components attached together.

Another embodiment is a cover for closing an attic access opening located at the top end of a permanent stairway within a building, the cover comprising a frame further comprising an aperture portion having an aperture of sufficient size to allow a person to pass therethrough and an extension portion; and a closure further comprising a protruding body portion and a flange portion; wherein the access opening is an opening in the ceiling of a lower level of the building and the floor of an upper level of the building to which the permanent stairway is connected to provide passage between the lower level and the upper level, and wherein when the cover comprising the frame having the aperture sealed by the separable closure is positioned in a covering relationship to the attic access opening, a barrier is created which substantially inhibits air and heat flow through the attic access opening. In an alternate embodiment this frame includes a surface that contacts the upper level in a generally surrounding relationship to the access opening, and a flange portion that depends into the access opening. The a still further embodiment, the closure comprises at least two separate components having cooperative surfaces with respect to each other, such that in order for the closure to seal with the frame, a component seal must be created between the components along the cooperative surfaces, which component seal significantly inhibits air and heat flow therethrough.

An embodiment is a system for closing an access opening to an attic space on one side of a wall within a building, the system comprising a generally vertical access opening within a generally vertical wall that separates an attic space on one side of the wall from other space within a building containing the attic space; an access opening frame in the wall that circumscribes the access opening; and a closure for closing the access opening, the closure comprising a protruding body portion having a proximal and distal end, the protruding body portion being sized and shaped to fit within a perimeter of the aperture when the protruding body portion is oriented with the distal end directed into the aperture; and a flange portion generally extending laterally from the proximal end of the protruding body portion, and having a circumference the area inside of which is greater than the area inside the interior perimeter of the access opening frame, the flange portion sized and shaped to contact at least one of the access opening frame or the wall external to the access opening on one side of the wall, thereby involving the closure in a seal circumscribing the access opening when the flange portion so contacts the frame or the wall; wherein when the cover comprising the frame having the aperture sealed by the closure is positioned in a covering relationship to the attic access opening, a barrier is created which substantially inhibits air and heat flow through the attic access opening.

An alternate embodiment of the system described immediately above comprises a partial frame piece having extending channel portions shaped to fit between structural members of the wall to close channels between the structural members, the channels leading away from the access opening and being of a dimension such that the channels are not otherwise closed upon the insertion of the closure into the access opening; wherein the partial frame piece, when positioned to close the channels, becomes a part of the access opening frame circumscribing the access opening. In another embodiment, the body portion is connected to an unmounted door that is sized and shaped generally to close the access opening; and wherein closure of the access opening with the door attached to the body portion of the closure causes the closure to form the seal circumscribing the access opening. In a further embodiment, the closure comprises at least two separate components having cooperative surfaces with respect to each other, such that in order for the closure to form the seal circumscribing the access opening, a closure seal must be created between the components along the cooperative surfaces, which seal significantly inhibits air and heat flow therethrough. In a still further embodiment, the access opening is a doorway at one end of a stairway.

An embodiment is a system for closing an access opening to an attic space on one side of a wall within a building, the system comprising a generally vertical access opening within a generally vertical wall that separates an attic space on one side of the wall from other space within a building containing the attic space; an access opening frame in the wall that circumscribes the access opening; a closure comprising a surface having a circumference and a surface area larger than the circumference of and area within an inner perimeter of the access opening frame, the surface sized and shaped to contact at least one of the access opening frame or the wall external to the access opening on one side of the wall, thereby involving the closure in a seal circumscribing the access opening; and at least two connectors for securely fastening the closure against the frame or the wall on one side of the wall; wherein the closure substantially inhibits air and heat flow through the access opening when the closure is securely fastened against the frame or the wall. In an embodiment the connectors are straps, chains, or hooks. In a further embodiment the closure comprises at least two separate components having cooperative surfaces with respect to each other, such that in order for the closure to substantially inhibit air and heat flow through the access opening, a seal must be created between the components along the cooperative surfaces, which seal significantly inhibits air and heat flow therethrough.

BRIEF DESCRIPTION OF THE DRAWINGS

FIG. 3 is an alternate embodiment of an insulating cover as shown in FIG. 2.

FIG. 4 is an alternate embodiment of a closure member having handles.

FIG. 15 shows a perspective view of an alternate embodiment of an insulating device used in a stairwell opening.

FIG. 18 shows front perspective view of the insulating device of FIG. 17 placed in a wall opening.

FIG. 19 shows a back perspective view of the insulating device of FIG. 17 placed in a wall opening.

DETAILED DESCRIPTION OF THE PREFERRED EMBODIMENT(S)

Figure 1:
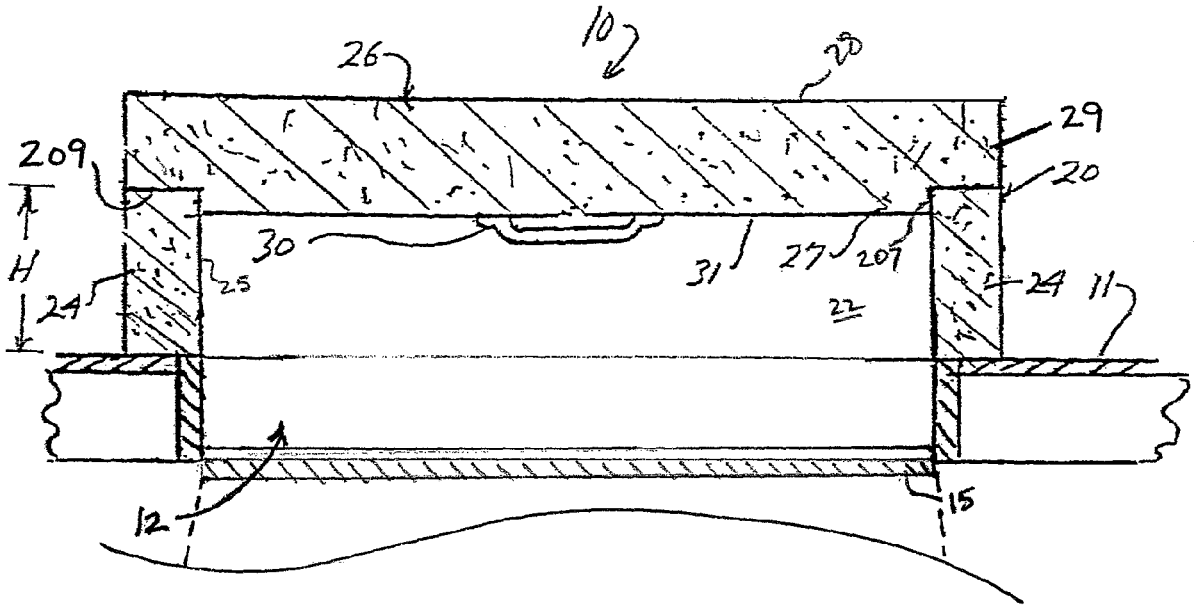
FIG. 1 is a cross sectional view of a first embodiment of an insulating cover showing the insulating cover mounted above a stairway to an upper level storage space.

Although the present invention will be described hereinafter with particular reference to the accompanying drawings, it is to be understood at the outset that it is contemplated that the present invention may be varied in specific detail from that illustrated and described herein while still achieving the desirable characteristics and features of the present invention. Accordingly, the description that follows is intended to be understood as a broad enabling disclosure directed to persons skilled in the applicable arts, and is not to be understood as being restrictive.

Described herein, among other things, are thermal and acoustic insulating covers for access openings to attics and other building spaces, which are not used regularly, e.g., spaces used for mid- to long-term storage rather than for frequent living or working activities. For convenience such spaces, which are separated from other parts of a building by an insulating closure as described herein, are referred to herein as storage spaces, whether or not actually used for storage, since use as a storage space generally is one practical use for such infrequently used spaces. One such insulating device is a device to insulate access openings to a storage space at the top of a permanent stairwell or other structure utilizing a standard vertical door entrance at the lower end of the stairs and a ceiling opening to be insulated at the top of the stairs. Another device is one to insulate an opening in a vertical wall behind which is located the storage space.

The covers for openings herein disclosed are made principally of material that is either thermally or acoustically insulating. Preferably, the insulating material is expanded polystyrene. In an embodiment, the cover has one or more coatings, any of which may serve to protect it from wear, provide fire resistance, or provide greater thermal or acoustic insulation. Additionally, the opening covers herein disclosed are preferably lightweight so that men, women and youth can readily maneuver the devices.

The present invention is designed to be lightweight and yet formed of insulating material that will provide for significant insulating value when the cover is placed into use. Because of the interfitting relationship of the closure member with the surfaces of an insulating frame or with a structural frame defining the opening, a generally air-tight seal is provided about the opening which further ensures significant insulating efficiency and reduction in noise transmission.

Moreover, the essentially air-tight seal, itself, provides for both fire and mold prevention, regardless of any coatings that may be on the cover, because of the reduction in air flow into or out of the storage space. Particularly with regard to attics, the flow of warm moist air from inside the building into the attic can cause moisture build-up in the attic when the moisture in the warm air condenses on colder surfaces in the attic. The condensed moisture can cause numerous problems, including wood rot and mold growth. Inhibition of air flow into the attic from other spaces in the building aids in inhibiting such problems caused by moisture in the attic.

Furthermore, a reduction in air flow into an attic space can aid in inhibiting fires. Since fire needs oxygen to continue, an air flow up into an attic space from other parts of a building can help to fuel a fire in the attic, whereas when the air flow is inhibited the fire is also inhibited.

A first embodiment of an access cover as herein described comprises two components. A first component is a frame that rests in, on, or about the access opening and generally within the storage space. A second component is a closure that joins with the frame in such a manner as to create a snug fitting, thereby sealing closed the opening. This two-component cover provides a thermally insulating device that generally has an insulating R-value similar to or greater than the rest of the insulation within and around the storage space. Additionally, the snug fit of the two components inhibits airflow therebetween. Gaps that allow air flow across an insulation barrier also allow energy loss and reduce the thermal and acoustic insulating properties of the barrier. Therefore, without such gaps, this cover provides an acoustically insulating device that inhibits sound transmission therethrough.

In an embodiment, both the closure and the frame can be moveable so as to provide the maximum flexibility for access through the opening, such as for moving relatively large objects therethrough. Alternatively, the frame is secured about the opening so as to be immoveable.

Either or both of the closure and the frame may have handles attached thereto so as to make easier the grasping, lifting, and moving thereof for access to the storage space. In some embodiments, the handles are mechanically secured to a separate rigid strip of wood, metal, or plastic, with the strip being formed to be secured to the closure member by being interfitted or keyed into assembled relationship therewith. In preferred embodiments, the handles are attached directly to the closure or frame, such as with the use of connecting pins, which may have barbs or other protruding portions. Such connecting pins may be, though need not be, used in conjunction with adhesive. In still further embodiments, the handles are molded into the material of the closure or frame.

A second embodiment of the cover includes only the closure. Generally, this second embodiment is utilized in an opening that includes and is defined at least partially by a frame to which the cover can be fitted similarly to the manner in which the closure is fitted to an insulating frame in a two-component cover. The frame of the opening to which a cover of this second embodiment may be joined may be made of any material, not necessarily a traditional insulating material; for instance such a frame may be a wood frame. In an embodiment, such a frame is either a roughed-in frame or a finished door frame. In an embodiment, the closure member includes a protruding body portion of a size to fit within the frame that at least partially defines the access opening to the storage space. In alternate embodiments, the protruding body portion fits either snuggly or, more preferably, not snuggly within the frame of the access opening. In an embodiment, which may have a protruding body portion fitting snuggly or not snuggly with the frame, the cover includes a peripheral flange portion extending outwardly from the protruding body portion so as to allow the closure to contact a second surface about the structural frame. In another embodiment, the closure does not include a flange portion, but is designed only to contact one surface about the frame.

Regarding either the first or second embodiment, in some applications a one-piece closure member can not be inserted through the access opening. Therefore, the closure members may be formed of two or more components which are designed to fit together at one or more joints after the components are inserted through the access opening. These closure components may be retained in assembled relationship by an adhesive or one or more latches or the joint may be designed so as to hold the components together without an adhesive or latch.

A first embodiment is disclosed in FIG. 1, which provides a cross-sectional view of an insulated cover 10 for an opening to a storage space. The cover 10 comprises a closure 26 and a frame 20, each of which may further comprise sub-portions or components. As shown in FIG. 1, the frame 20 of this embodiment is mounted so as to rest on a floor 11 of the storage space, in surrounding relationship with respect to the opening 12, through which leads a set of stairs 15. The insulated cover 10 includes an open frame 20 having side walls 22 and end walls 24. In the embodiment shown, the frame is generally rectangular or square in configuration, though in alternate embodiments the frame can take any shape, and particularly has a shape so as to allow the frame to have a surrounding relationship with the opening. The height "H" of the walls of the frame is sufficient that the upper edge of the frame extends above any stairs that may be positioned within the access opening. Additionally, in an embodiment, the height H of the frame allows for easier opening of the closure 26 as a person walks up the stairs 15 by allowing for more head room as the person gets closer to the top end of the stairs 15.

The frame 20 preferably has a circumference of a size and shape at least substantially identical to the size and shape of the perimeter of the opening 12 at the floor 11 of the storage space, so as not to interfere with the access opening 12, as shown in FIG. 1—an example of a surrounding relationship. In alternate embodiments, the surrounding relationship of the frame 20 to the opening 12 includes that the frame 20 encroaches into the access opening 12, or has a shape and size larger than those of the opening 12. The frame 20 is designed such that it may simply rest on the floor of the storage space; however, in an embodiment, the frame 20 may be secured to the floor.

Both the frame 20 and the closure 26 are preferably made of lightweight, dense, insulating, man-made board such as an expanded polystyrene material. In alternate embodiments, the material from which the cover 10 is made may be any material but preferably is a material that when all the pieces of the cover 10 are fit snuggly together and used to snuggly close an access opening, provides a substantial thermal barrier, so as to inhibit the loss of cool air from the more commonly used spaces within the building when the ambient temperature (outside the building) is warmer than desired inside the commonly used spaces, and to inhibit the loss of warm air from the more commonly used spaces when the ambient weather (outside the building) is cooler than desired inside the commonly used spaces.

In the embodiment of FIG. 1, the closure 26 includes a protruding body portion 27 which depends below or extends outwardly relative to an upper portion 28 to which said protruding body portion 27 is attached at a proximal end of such protruding body portion 27. From the upper portion 28 extends laterally a flange portion 29. The protruding body portion 27 is specifically designed to fit within an area internal to and defined by the frame 20, as shown in FIG. 1. The protruding body portion 27 is preferably sized and shaped just smaller than the size an shape of the circumference of the internal opening within the frame. In an embodiment the protruding body portion is of a size and shape to snugly and frictionally engage with the inner wall 25 of the frame at a first seal 207. The flange portion 29 extends outwardly from the protruding body portion 27, and is designed to engage a second surface of the frame 20 when the protruding body portion 27 is positioned within the internal opening of the frame 20, thereby creating a seal 209. In a preferred embodiment, the flange portion 29 has a dimension such that the outer edges thereof come into general alignment with the outer edges of the frame 20 so that the flange portion 29 of the closure 26 does not extend beyond the external periphery of the frame 20, as shown in FIG. 1. This interfitting relationship between the closure 26 and the frame 20 forms a generally "L-shaped" seal, the shape of which helps to inhibit air from passing between the closure 26 and the frame 20, when the closure 26 and frame 20 are engaged, as shown in FIG. 1, thereby providing high thermal efficiency when in use, as well as reducing the passing of noise through the access opening.

Figure 2A:
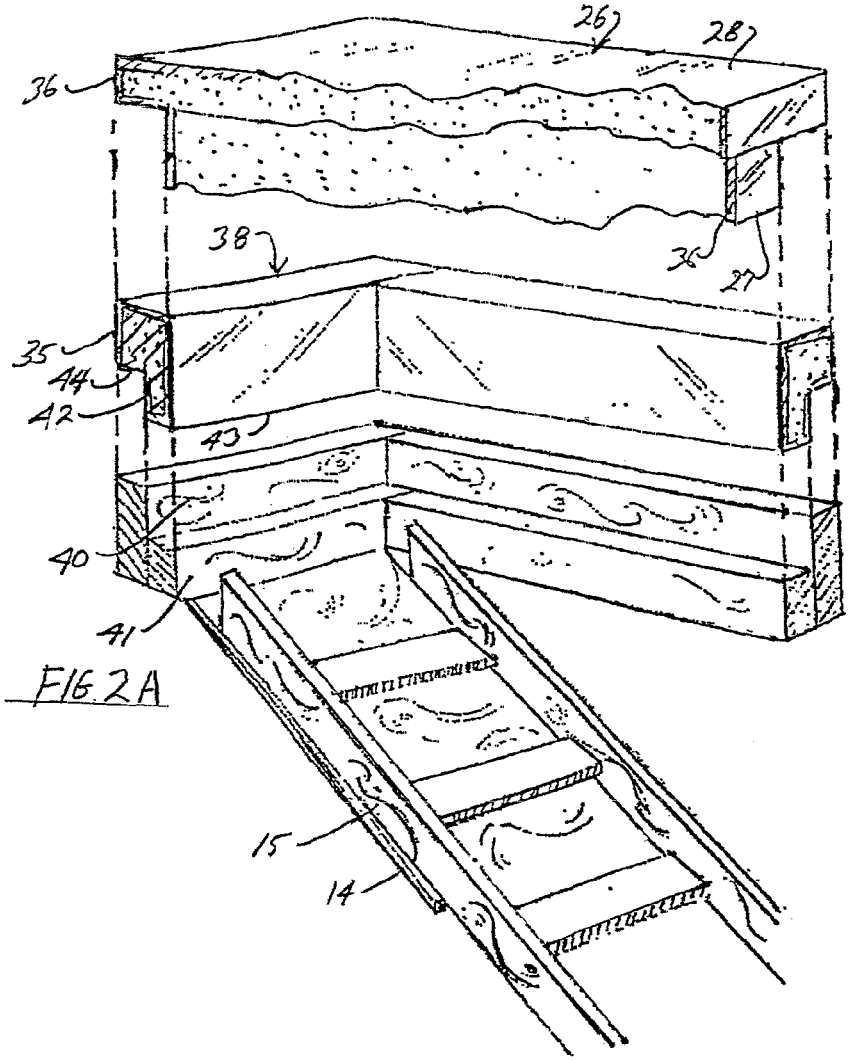
FIG. 2A is a perspective view showing an alternate embodiment of the insulating cover having an insulating frame with both a depending flange portion and a laterally extending flange portion.
Figure 2B:
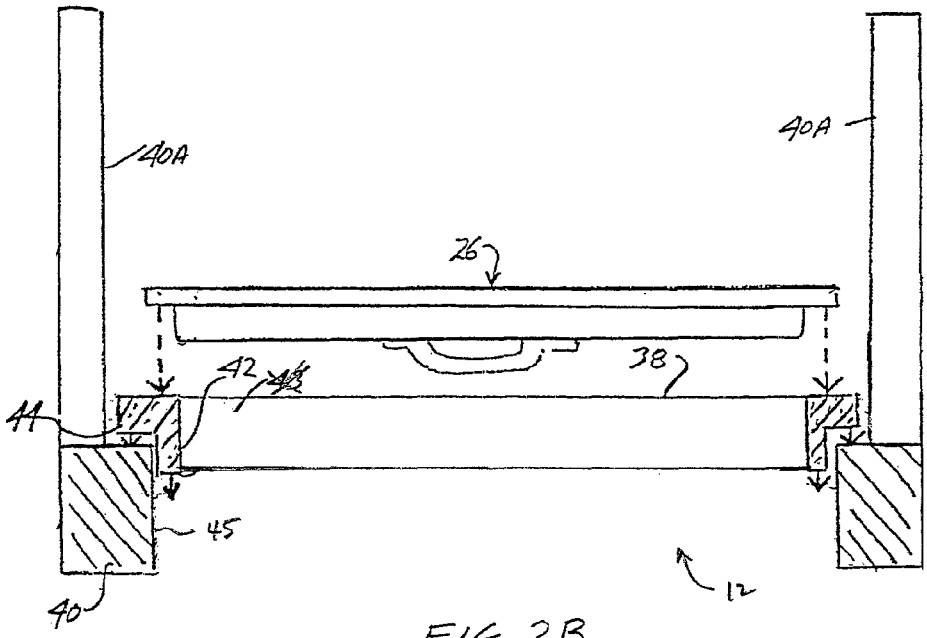
FIG. 2B is a cross sectional view of an embodiment such as shown in FIG. 2A, though wherein the opening frame is supported by vertical trusses.

In preferred embodiments, as shown in FIG. 4, one or more handles 30 are provided, which extend from the lower surface 31 of the protruding body portion 27 of the closure member 26. The handle or handles 30 may be used to aid a person to engage or disengage the closure member 26 with the frame 20, such as for moving the closure away from the opening 12 to allow access to the storage space. Also, as shown in FIG. 3 with respect to a frame 38 of an embodiment as shown in FIG. 2, to facilitate maneuvering of the frame 20 or 38, when the frame 20 or 38 is moveable and not secured about the opening 12, handles 32 may be secured to one or more side walls thereof, either inside the aperture 9 of the frame or outside the frame, as shown.

Further, to provide for safety, ease of assembly and durability, in an embodiment, the pieces of the insulation cover 10 are sealed with a sealant. In an alternate embodiment, the pieces of the insulation cover 10 are coated with a fireproof material, as shown at 35 and 36 in FIG. 2. The fire retardant coated layers are preferably an elastomeric resin. The fireproof or retardant coating may be paints or sealants which meet fire hazard classifications ASTM E-84 (NFPA 255) Class A. One such product is Sherman Williams™ Flame Control No. 20-20, an intumescent material.

FIGS. 2A-4 show another embodiment in which the closure 26 is the same as that shown in and described with respect to FIG. 1; however, the insulating frame 38 is designed to be seated partially within an opening frame 40, which defines the opening 12 into the storage space. In alternate embodiments, opening frame 40 is either exposed roughed-in framing material used in constructing the access opening 12 or may be a finish material such as a finish frame. In a further embodiment, though unlikely in the context of an opening at the top of a permanent stairway, the opening frame 40 may be connected to or suspended from vertical support trusses 40A. In these instances the frame 38 must fit with the opening frame 40 without interference with the trusses 40A.

The insulating frame 38 of this embodiment is formed with an inner depending flange 42. The shape and size of the frame 38 with flange 42 allows the flange 42 to contact the inner sides 45 of the opening frame 40 and to frictionally engage therewith when said flange 42 is positioned within the access opening. With this insulating frame structure, the upper and outer portion of the frame 38 may also be considered a flange 44, which is positioned in surrounding relationship to the access opening 12, extending around the periphery thereof, and which either seals against the upper portion of the frame 40 or seals against the floor of the upper level of the building accessible via the stairway (not shown in FIG. 2B. In this embodiment, as shown in FIGS. 2A-4, the materials of the frame 38 and closure 26, as well as the manner in which the closure 26 seals with respect to the frame 38 is the same as that previously described with respect to FIG. 1.

Figure 5:
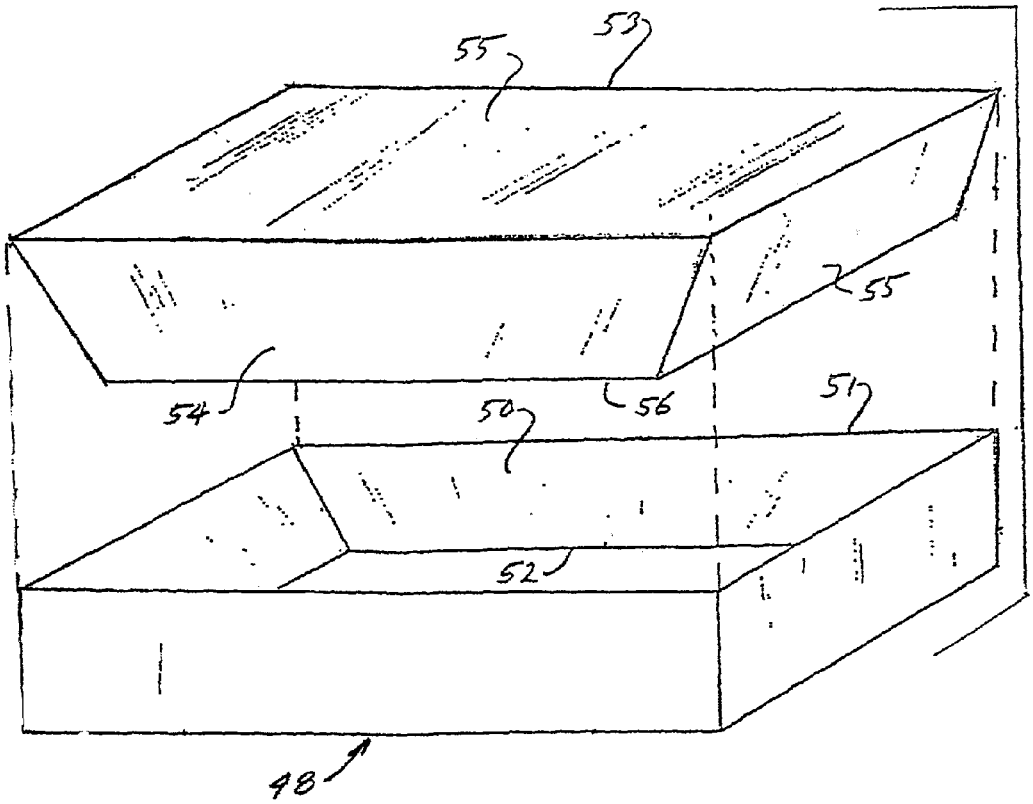
FIG. 5 is a perspective assembly view of an alternate embodiment of an insulating cover having a beveled seal.

Another embodiment is shown in FIG. 5. As opposed to the cover 10 of FIG. 1, having the closure 26 and frame 20 configured to form a generally L-shape seal area, the frame 48 of the embodiment shown in FIG. 5 is formed having internally beveled surfaces 50 which extend inwardly from upper edges 51 toward lower edges 52 thereof such that the inner side walls taper inwardly from the top to the bottom of the frame. A closure member 53 includes opposite side walls 54 and opposite end walls 55 each of which is beveled inwardly from the top 55 toward the bottom 56 of the closure member. The configurations of the beveled surfaces are designed such that the closure member 53 seats and seals through frictional engagement with the side walls thereof against the tapered side walls of the frame. The material used in this embodiment may be any of the material previously described with respect to FIG. 1. Although, not shown in FIG. 5, appropriate handles may also be provided on the frame 48 and on the closure member 53 to facilitate maneuvering of each component when necessary.

In still further embodiments, the seal between the closure member 26 or 53 and the frame 20 or 48, respectively for FIGS. 1 and 5, is some combination of the seals of the embodiments shown in these FIGS., such as where the protruding body portion 27 of the embodiment shown in FIG. 1 seats into the frame 20 along a beveled seal.

Figure 6:
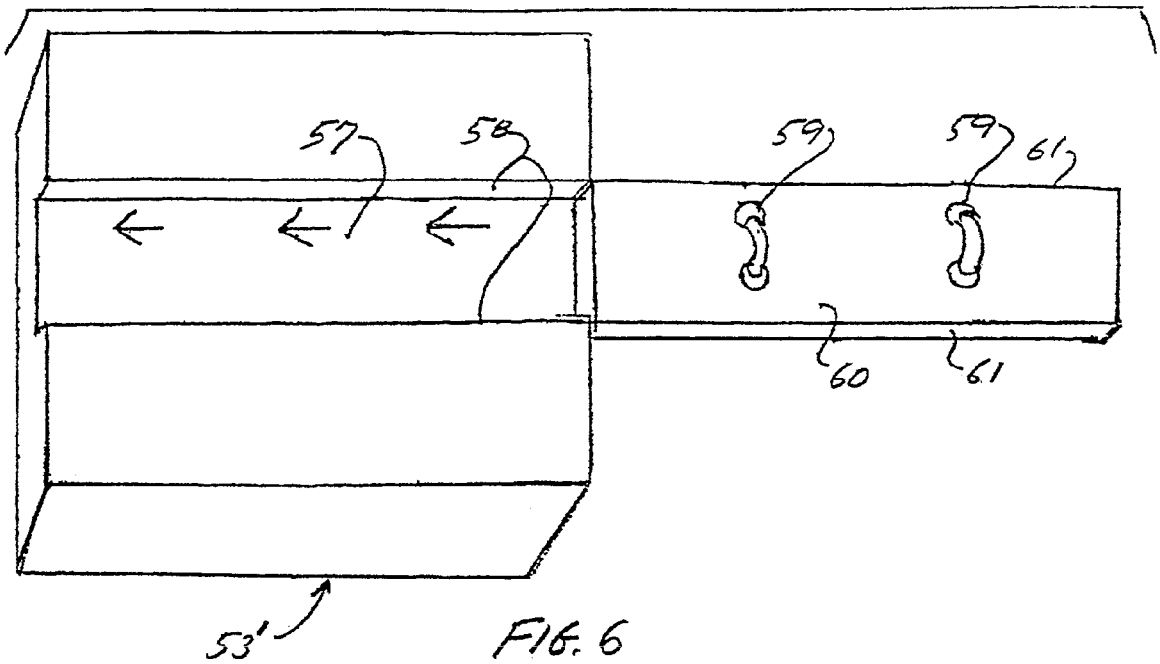
FIG. 6 is a perspective assembly view of a manner of securing handles to a closure member.

With specific reference to FIG. 6, a manner of securing handles to various embodiments is shown. A closure member 53' similar to that shown in FIG. 5, is shown as including a groove or channel 57 formed therein defined by undercut or beveled opposing edges 58. In an embodiment, the channel 57 is formed during molding of the closure 53'. Handles 59 are secured by mechanical fasteners to a slide strip 60 constructed of wood, plastic or metal, which is mechanically able to retain the fasteners without fracturing or otherwise becoming damaged under typical use. The side edges 61 of the strip 60 are beveled to interlock within the channel edges 58 by sliding the strip 61 into the channel 57, as shown by the arrows in FIG. 6. In an embodiment, glue or other adhesive is used to secure the strip to the closure member, while in some embodiments no adhesive is used. This manner of securing the handles is useful in some embodiments, since the material from which the closure members and frames are constructed is subject to material failure as a result of the forces applied thereto by use of the handles in the expected manner (i.e., for lifting and moving the portions of the insulation closure).

With reference to FIG. 7, another embodiment of the invention is disclosed. This embodiment is particularly suited for use with access openings that are defined by structural or roughed-in frames 63 to which finishing strips 64 are attached to define a peripheral ledge against which can rest an unmounted door 65. In this embodiment, only the closure member 66 is used and no insulation frame 20 or 38 is used, as is the case in the previously described embodiments. Most commonly in this embodiment, the opening 12 will be an opening in a generally vertical wall, such as is the opening shown with respect to a different embodiment in FIGS. 17-18.

As shown in FIG. 7, the closure member 66 is constructed in the same manner as the closure member described with respect to FIG. 1, having a protruding body portion 67, which is of a size to fit closely, and in some embodiments snugly, about the inner circumference within the structural or roughed-in frame 63. A peripheral flange 68 of the closure 66 extends from the body and is designed to provide a seal against a second surface 69 of the structural frame 63. Although not shown, handles may be provided. The closure 66 is constructed of the same insulating material described with respect to previous embodiments, such as shown in FIG. 1, and may be sealed with a plastic sealing material or coated with a fireproof coating, or both, as previously described.

Figure 7A:
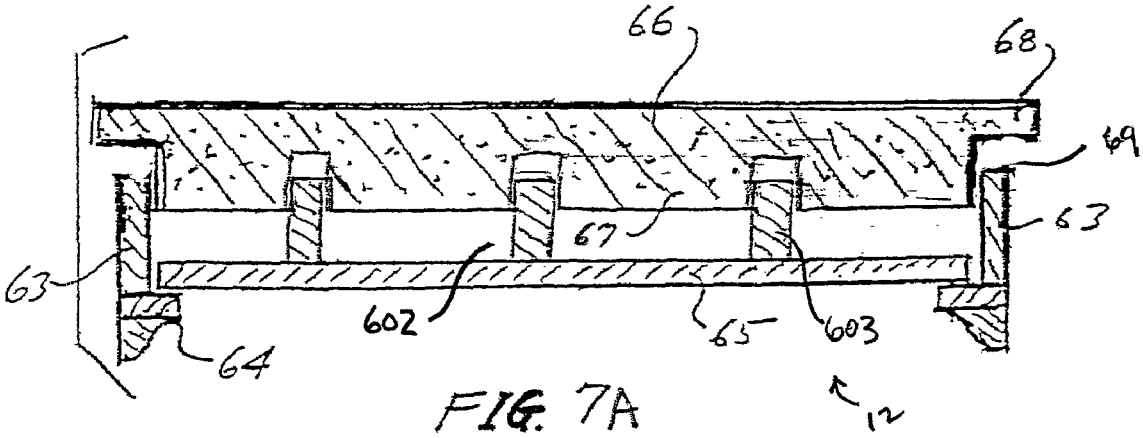
FIG. 7A is a cross-sectional view of an embodiment of a closure wherein extending body portions for the purpose of sealing channels left open in an access opening that does not have a complete opening frame.

In yet another embodiment, as shown in FIG. 7A, the closure 66 includes one or more body portions that extend downwardly to make the insulating seal in a circumstance where the structural or roughed-in frame 63 is not coextensive with the circumference of the opening 12. With such an incomplete structural or roughed-in frame 63, the access opening may be connected with channels 602 that run between and parallel to ceiling or wall joists 603, which channels 602 would otherwise be interrupted at the opening 12 by a complete structural frame 63. If not sealed by a structural frame 63, the channels 602 provide a breach in the insulating seal about the access opening. Body portions 67 of sufficient length so as to extend to cover the channels 602 may be used to compensate for the sections of the circumference of the access opening 12 that would otherwise be sealed by the frame 63. In such case, such downwardly extending body portions 67 may be sized and shaped to fit snuggly about one or more ceiling joists or wall studs, the ends of which abut the access opening. Such an embodiment is shown in FIG. 7A.

In an alternate embodiment a partial insulating frame extends only along a portion of the circumference of the opening 12 for which there is no structural or roughed-in frame 63 closing the channels 602. After the partial insulating frame piece is set in place about the joists or studs 603, thereby closing the channels 602 and completing the frame about the access opening 12, a closure 66 can be closely fit within the access opening 12 nearly against the structural or roughed-in frame 63 and the partial insulating frame having portions that extend to close the channels 602 so that the opening 12 is sealed.

Figure 7B:
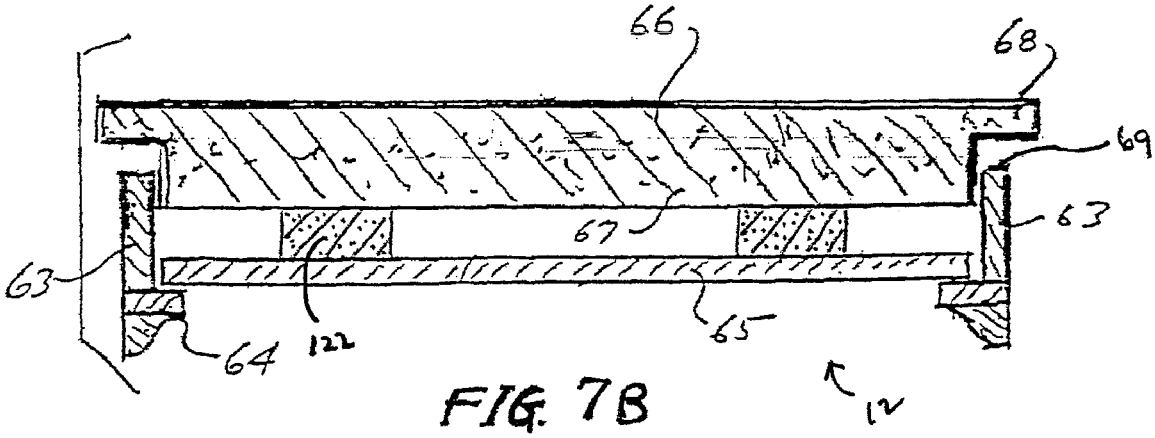
FIG. 7B a cross-sectional view of an alternate embodiment of a closure which is attached to an unmounted door.

In a still further embodiment, shown in FIG. 7B, an unmounted door 65 is connected directly or via connection members 122 to the closure member 66. In this way, both the door 65 and the closure member 66 are simultaneously displaced when a person moves either of them. Such a connection may make entrance and exit from the attic more convenient. Such a connection can also be made through an insulating frame having a depending portion such as shown in FIG. 2, wherein the depending portion contacts and is connected to an unmounted door, and whereupon the lifting of the unmounted door also moves the insulating frame and closure connected thereto.

In some instances, attic access openings are relative small or positioned close to a roof line thereby limiting the ability to insert single piece closure members into position. The present embodiment includes variations wherein the closure member is formed of two or more interfitting components which may be fit together after being inserted through an access opening.

Figure 8:
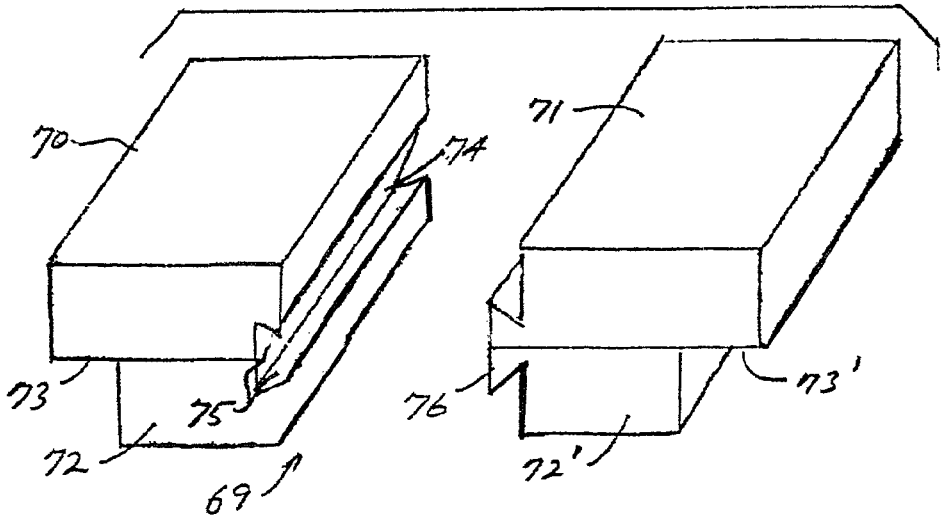
FIG. 8 is a perspective assembly view showing an embodiment of a closure that is formed from two interlocking components.

In an embodiment, shown in FIG. 8, the closure member 69 includes two components 70 and 71, each having a body segment 72 and 72', respectively, and upper flange segment 73 and 73', respectively. Component 70 includes a channel 74 having opposing beveled side walls 75 into which an elongated tongue or flange 76 of the opposing component may be slidingly received to fit the components together. The shapes of the channel 74 and tongue 76 are such that the two components 70 and 71 may be interlocked by sliding relative to one another to thereby form a single closure member 69. These interlocking segments are an example of cooperative surfaces of the components of the closure 69. In an embodiment, adhesive or glue is applied to the joint at channel 74 or tongue 76 or both prior to fitting together the components 70 and 71, in order to bond the components together at the tongue 76 and channel 74. Application of an adhesive tape may be made at the time of manufacture for the same purpose, such that the end user need not apply glue or adhesive during assembly.

Many variations of cooperative surfaces, such as variations in the shape and size of the tongue 76 and channel 74 are exhibited in various embodiments, some examples of which are shown in FIGS. 9-12. The general configuration of and the materials from which the assembled closure member is formed are the same as discussed with respect to the previous embodiments. In the drawing figures, only a portion of each closure is shown for purposes of illustrating the interlocking relationship therebetween. In some embodiments the cooperating surfaces do not interlock, such as does a tongue and channel, but are simply shaped to have cooperating surfaces, for example, as would be created when an integral closure is cleanly cut into two pieces. The surfaces created by the cut necessarily are cooperating surfaces, since they have correlated shapes. No cut is necessary to make cooperating surfaces, though, since cooperating surfaces can be formed during manufacturing of closure components.

Figure 9:
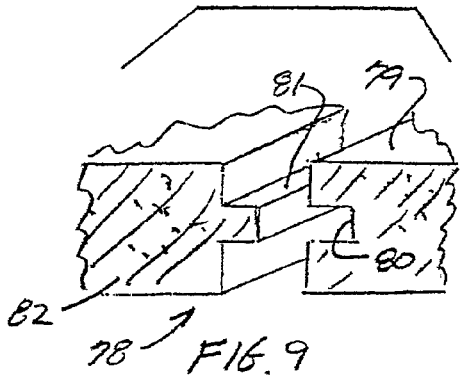

In FIG. 9 a variation is disclosed in which the closure member 78 includes a first component 79 having a generally u-shaped channel 80 into which a protruding tongue 81 of an opposing component 82 may be received. The components may be secured as previously described to thereby form a single closure member. An adhesive may be used to bond the components at the joint.

Figure 10:
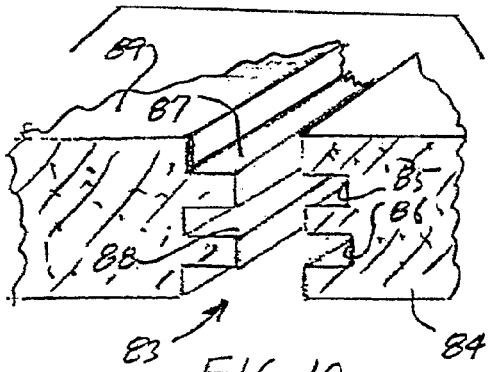

In FIG. 10, the closure member 83 includes a first component 84 having a pair of slots 85 and 86 which are generally u-shaped in cross-section and which receive protruding tongues or flanges 87 and 88, which extend from an opposing edge of frame component 89. The components may be secured as previously described to thereby form a single closure member. An adhesive may be used to bond the components at the joint.

Figure 11:
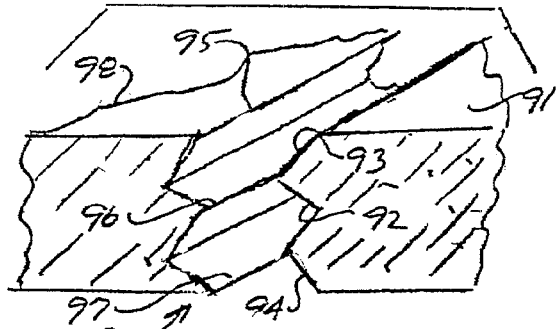

In FIG. 11, another type of sealing relationship is disclosed between opposing edges of two components of a closure member 90. In this variation, the closure member includes a first component 91 including a central v-shaped channel 92 defined by opposing beveled edges and outer beveled edges 93 and 94. The beveled edges cooperate with elongated tapered flanges 95, 96 and 97 defined along the opposing edge of component 98 such that when the members are seated with respect to one another, a very tight seal is created therebetween. The components may be secured as previously described to thereby form a single closure member. An adhesive may be used to bond the components at the joint.

Figure 12:
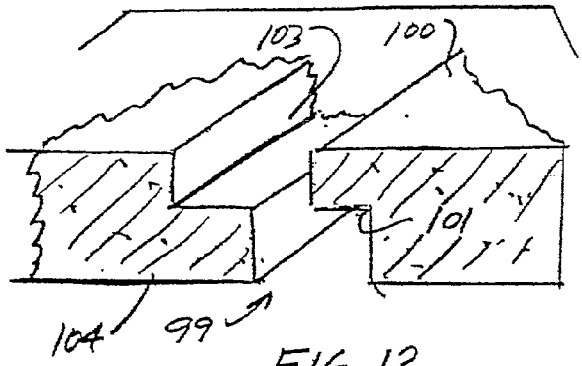
FIGS. 9-12 are partial cross-sectional views of an alternate embodiments of closures formed from two interlocking components wherein the interlocking surfaces have various structures.

With specific reference to FIG. 12 a further variation of the present embodiment is disclosed. In this embodiment, the closure member 99 includes a first component 100 having an L-shaped cut-out or recess formed along each of the side and end walls, as shown at 101, which is of a size to cooperatively engage an L-shaped cut-out 103 formed in the opposing edge portion of component 104. The components may be secured as previously described to thereby form a single closure member. An adhesive may be used to bond the components at the joint.

Embodiments of the insulating cover 10 for use at the top of a stairway are shown in FIGS. 13-16. This device is used in a storage space entrance accessed via a set of stairs. The storage space may be at either the top of the stairs, as would be an attic, or at the bottom of the stairs. Although the embodiments shown in FIGS. 13-16 have an overall rectangular shape, the shape of the device need not be rectangular, and can be any shape needed to fill the opening at the top of a stairway, including shapes that can generally be referred to as an L-shape or a U-shape.

Figures 13, 14:
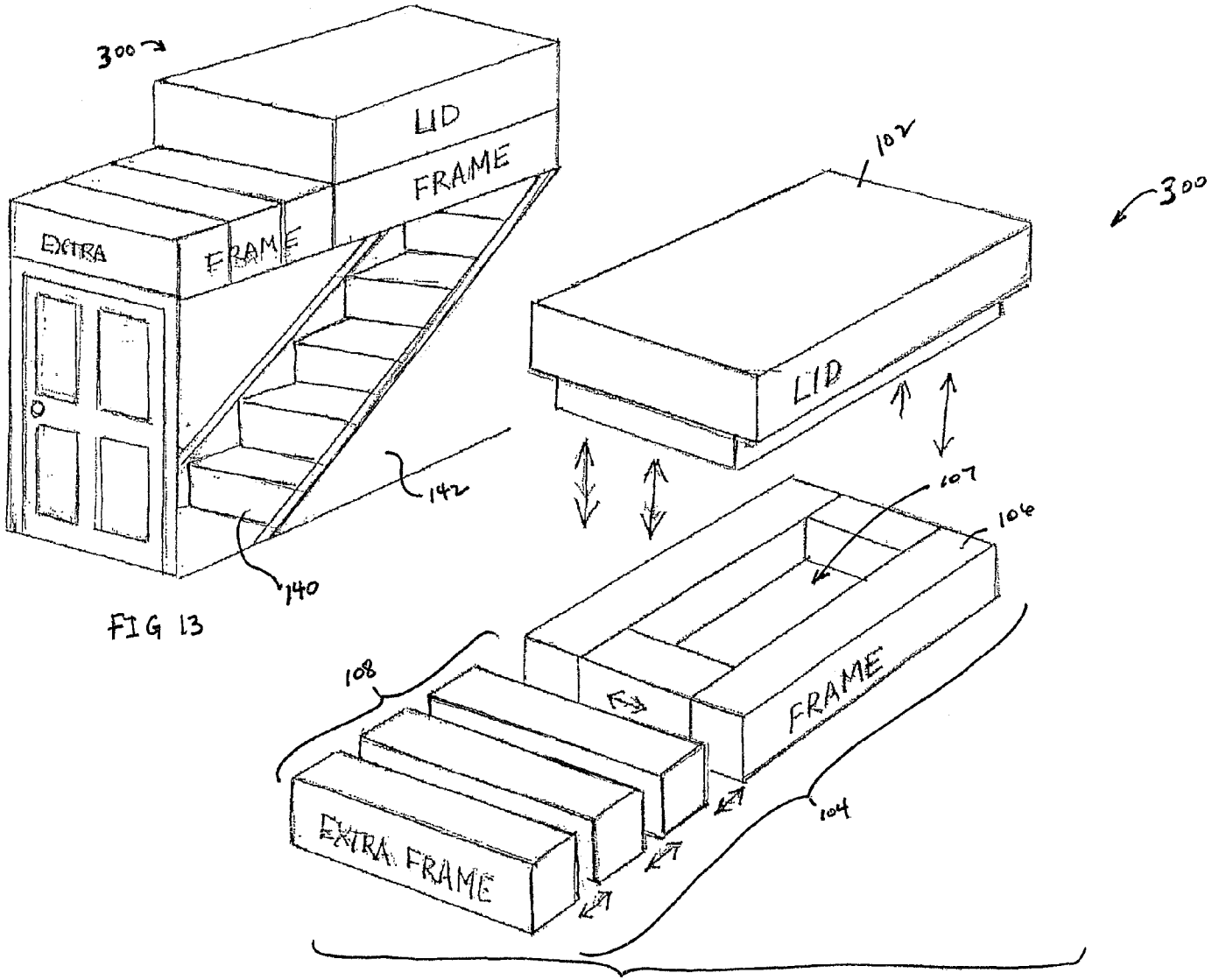
FIG. 13 shows a perspective view of an insulating device used in a stairwell opening.
FIG. 14 shows a perspective view of the insulating device of FIG. 13 apart from its environment of use.

In an embodiment, such as is shown in FIG. 13, the stairway, and therefore the storage space, is accessed through a wall opening in which is mounted a door. In such case, the stairway typically exists within a stairwell, which is the shaft through which the stairway runs. In an embodiment the stairwell shaft is generally enclosed by the stairs on the bottom and walls, two generally vertical side walls and a top wall (ceiling) generally parallel to the stairway. Alternately, in an embodiment, the stairway is an "open" stairway, either without a top wall or without any walls, typically then having only a railing.

The insulating device 300, shown independently of the environment of its use in FIG. 14, is comprised of two components, a closure 102 and a frame 104. As with the first embodiment shown in FIG. 1, the closure 102 is designed to fit closely in association with a portion of the frame 104 to provide an insulating device. The fit may be accomplished by any of the methods discussed above, such as the frictional engagement of a protruding body portion of the closure 102, or a beveled engagement as described with respect to FIG. 5, or, preferably, simply a close, but not snug, fit between a protruding body portion and the internal walls of the frame.

The frame 104 is generally comprised of two portions, a first portion 106 that has an internal aperture 107 that is shaped to fit closely with and be closed by the closure 102, as discussed above, and a second portion 108 that does not have an opening, and that extends the frame to cover the entire stairway opening cut into the storage space floor. The second portion 108 may extend the frame 104 in any one or more spatial directions in order to fit over the entire stairway opening in the floor of the storage space. As shown in FIGS. 13-14, the second portion 108 extends the frame 104 along a spatial direction generally parallel with the stairs 140. As shown in an alternate embodiment in FIGS. 15-16, the second portion 108 extends the frame 104 along two spatial directions, one direction being generally parallel with the stairway 140, and the other direction being generally perpendicular thereto.

In the depicted embodiments, the internal aperture 107 in the frame 104 is sized and shaped to allow an individual human to pass therethrough in a manner that is reasonably comfortable for the person when walking up the stairs. The aperture 107, however, may be of any size and shape. In particular, in an alternative embodiment, the aperture 107, may be significantly larger than shown, such that the aperture 107 encompasses a greater proportion, or all, of the stairwell opening. Generally, a larger internal aperture 107 in the frame 104 requires a larger closure 102, which easily may become too unwieldy to be practical. Generally, a smaller closure 102 is easier for a person to maneuver when engaging and disengaging the closure 102.

As indicated in FIGS. 13 and 15, the frame 104 is designed to be larger than the opening cut into the floor of the upper-level storage space to allow access by the stairs 140. Where the stairwell walls 142 do not extend above the storage space floor, the frame 104 may simply rest on that floor, as discussed with reference to FIG. 1. In this way, both the closure 102 and the frame 104 may remain movable, providing the greatest flexibility for accessing the storage space without having any portion of the insulating device interfering with such access. Alternately, the frame 104 may be attached to the attic floor by any suitable method, such as those described above, including an adhesive, and specifically including a caulk. In a further alternate embodiment, the frame 104, including either or both of the first and second portions 106 and 108, may be fabricated with a depending flange, such as discussed above with respect to FIG. 2B.

Where the stairwell walls 142 extend above the upper-level storage space floor but not to the ceiling thereof, if such ceiling is present, otherwise to the rafters thereof, the frame 104 may rest on or be attached to the top of the stairwell walls 142. In this case, a vertical extension of the frame may be necessary to close the opening at the top of the stairs between the storage space floor and the top of the stairwell walls 142. Alternately, where the stairwell wall 142 extends above the attic floor, the frame 104 may be attached directly to the vertical face of the stairwell wall 142 at any appropriate height, such as the height of the storage space floor. Where the stairwell is enclosed, as discussed above, the frame 104 may be attached to the shaft walls and the stairway.

Each of the closure 102, and the frame 104, including the first portion 106 and second portion 108, may be further comprised of components attached together with any suitable manner for so attaching. Examples of ways in which to attach together components of the closure 102 and frame 104 include the use of interlocking shapes, such as discussed above, particularly with respect to FIGS. 8-12; the use of an adhesive, such as a glue or caulk; the use of an adhesive tape, such as a double-sided adhesive tape; the use of a post or pin attached to and extending from a first component and into a second component to which it is also attached; and the use of straps, such as straps connected to and extending generally perpendicularly across a joint between each of two abutting components. A pin or post for such purpose may have a variety of shapes and sizes, including having a head or not on either or both ends or having barbs to aid in securing the pin to the component. Any of these attachment methods may be used alone and more than one method of attachment may be used to attach one component to another. An advantage of constructing the insulating device of components is that the components can be shipped independently and can be put together at or near the place of installation of the insulating device 300.

Figures 16, 17:
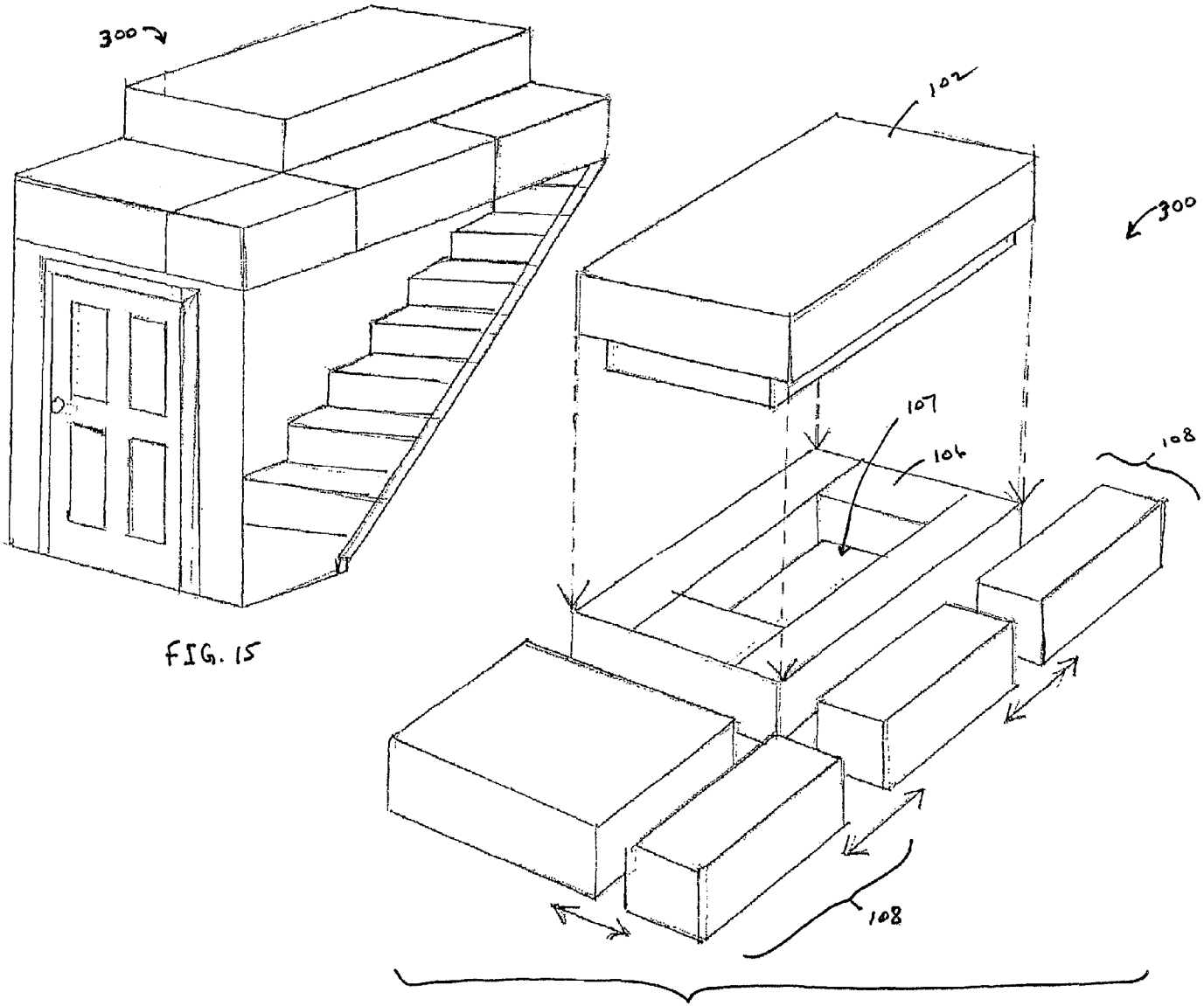
FIG. 16 shows a perspective view of the insulating device of FIG. 15 apart from its environment of use.
FIG. 17 shows a cut-away perspective view of an insulating device used in a generally vertical wall entrance opening.
Figure 17:
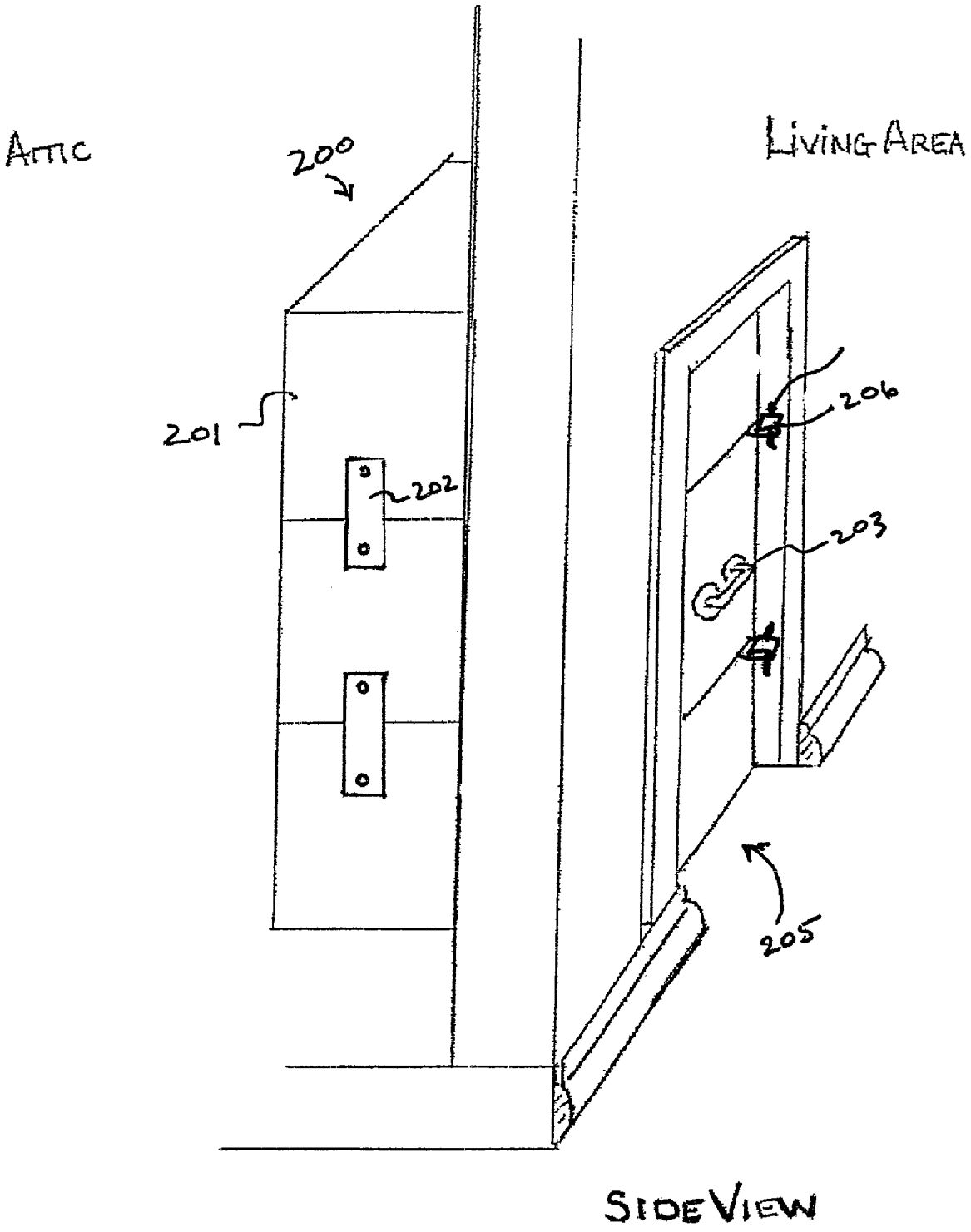
Figure 20:
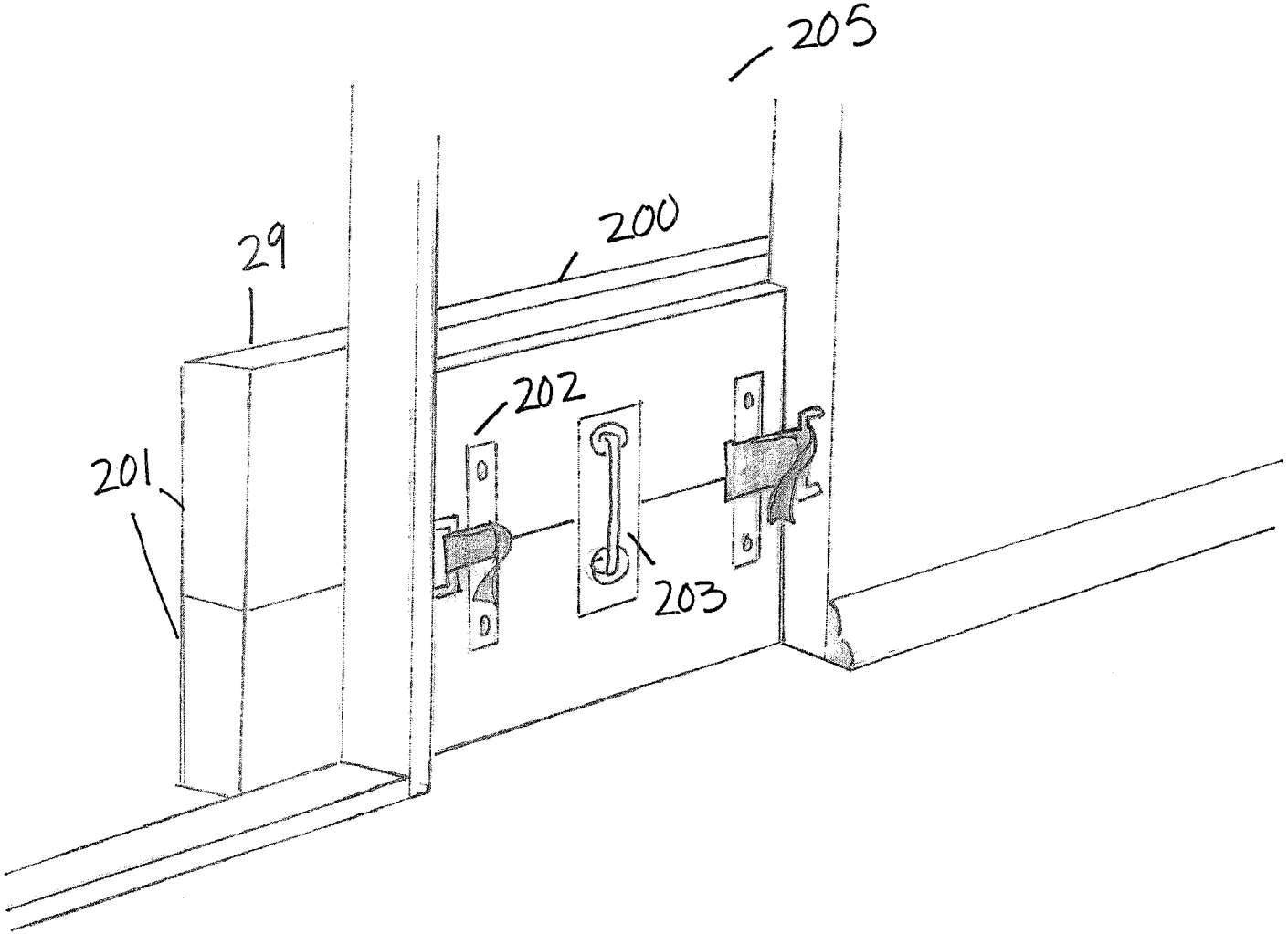
FIG. 20 shows a side perspective view of the insulating device of FIG. 17 placed in a wall opening.

Another embodiment is the insulating device 200, shown in FIGS. 17-19. This insulating device 200 is used to insulate a wall-entrance opening 205 to a storage space. Such an opening 205 may occur as an entrance through a wall to an attic-type space above the eaves of a house, may occur as an entrance to a stairway leading to a storage space, or may occur anywhere the space generally used for daily living is divided from non-living space by a vertical wall with an opening therein. Such an opening may have a door, such as a simple plywood cover 204, generally used to separate the spaces on either side of the opening 205.

In an embodiment, this insulating device 200 is a closure without an insulating frame 104. The closure 200 may be comprised of component portions 201, such as the three component portions shown in FIG. 17. The closure 200 is generally designed to be larger than the wall opening 205 being insulated by the closure 200. An advantage of providing the closure 200 in more than one component is in getting the closure 200 through the opening 205 into the storage space. Once in the storage space, the component portions can be attached together to form the closure 200. Attachment may be achieved by any suitable method, including those described above for the attachment of components of the frame 104, such as an interlocking joint, an adhesive, an adhesive tape, a post or pin, a strap 202, or any combination thereof.

As discussed above with respect to other devices, the closure 200 may have one or more handles 203.

In an embodiment, the insulating device 200 is fabricated to include a protruding body portion that extends into and frictionally engages to fit snuggly in the opening 205. Such a snug fit may be designed similarly to the fit between the protruding body portion 67 of the closure member 66 and the structural or roughed-in frame 63 shown in FIG. 7. In an embodiment, the protruding body portion fits closely, but not snuggly, with the frame.

In an alternate embodiment, the insulating device 200 has no protruding body portion for extending into the opening 205, but has a surface that can be held tightly against one side of the opening 205. By tightly fitting against one side of the opening 205, the insulating properties of the device are enhanced as compared with a circumstance where the device 200 is poorly engaged with the opening 205. The snug fit against one side of the opening 205 may be achieved through the use of straps 206 that maintain a certain tension, which provides a force generally pulling the closure 200 against the opening 205. The straps 206 may be made to be an integral part of the closure 200 during assembly of the components 201 of the closure 200. To further improve insulating properties, weather stripping or a similar material may be placed around the periphery of opening 205 so that the device 200 interacts with the weather stripping or similar material when the closure is tensioned against it. The straps 206 are more generally any practical connector that can maintain the position of the device 200 in a closing relationship to the opening 205. Other examples of such connectors include chains and hooks.

In an embodiment as shown in FIGS. 17-19, the straps 206 are placed between the component portions 201 before the component portions 201 are attached together. In this way, the straps 206 are attached to the closure 200 between the component portions 201. The straps 206 may be made more secure to the closure 200 by the wrapping of a length of the strap 206 around the back side 208 of the closure 200, and securing the wrapped end of the strap 206 with a pin, nail, or other similar device 207 that protrudes through the strap 206 and into the closure 200.

Once constructed and placed in front of the opening 205, the closure 200 may be pulled against the back of the opening 205 by pulling on the handle 203 or on the straps 206. The closure 200 seals against the frame of the opening 205 or the wall external to the opening 205, such frame generally including a portion of the floor when the access opening 205 is open down to the floor rather than being elevated off the floor. To maintain the snug contact of the closure 200 with the frame of the opening 205 or the wall about the opening 205, the straps can be secured through the opening 205, such as to the frame thereof or to the wall on the opposite side as is positioned the closure 200, by any suitable method, including connecting with connectors to a post or eyelet or other protrusion from the wall or the frame of the opening 205. In the depicted embodiment, the straps pass through a unshaped loop or handle on the inside periphery of opening 205 and are looped back upon themselves to attach the strap 206 to itself, such as through the use of a hook and loop type fabric attachment device (such as those sold under the brand name of Velcro), snaps, buttons, a buckle, or other similar devices.

While the inventions have been disclosed in connection with certain preferred embodiments, this should not be taken as a limitation to all of the provided details of any invention. Modifications and variations of the described embodiments may be made without departing from the spirit and scope of any invention herein disclosed, and other embodiments should be understood to be encompassed in the present disclosure as would be understood by those of ordinary skill in the art.

The invention claimed is:

1. A system for closing and insulating an access opening to a first space, said system comprising:

a generally vertical access opening, said access opening being within a wall that separates said first space from another space within a building and contacting a floor of said building;

an existing structural frame within said wall, such that the combination of said structural frame and said floor circumscribes said access opening;

a door placed within said existing structural frame for closing, but not sealing, said access opening;

a closure for closing and sealing said access opening, said closure comprising:

a protruding body portion, said protruding body portion being sized and shaped to fit within said existing structural frame to create a first seal between said protruding body portion and said existing structural frame when said protruding body portion is directed into said access opening;

a flange portion integral to and extending laterally from said protruding body portion, said flange portion:

having a perimeter the area inside of which is greater than the area of said access opening;

having a continuous surface within said area; and being sized and shaped to directly contact a second surface about said existing structural frame to create a second seal between said flange portion and said existing structural frame; and a handle, said handle projecting from said protruding body portion at a side opposite said flange portion;

wherein when said closure closes said generally vertical access opening, the combination of said first seal and said second seal substantially inhibits air from passing between said first space and said other space; and wherein said closure and said door can simultaneously close said access opening.

2. The system of claim 1, wherein when said closure closes said generally vertical access opening, the combination of said first seal and said second seal substantially inhibits air from passing between said first space and said other space within a building to ensure significant reduction in noise transmission.

3. The system of claim 1, wherein said closure is comprised of a thermally insulating material.

4. The system of claim 1, wherein said closure is comprised of an acoustically insulating material.

5. The system of claim 1, wherein said closure may be formed of two or more components which tightly fit together at one or more joins.

6. The system of claim 5, wherein said joins are assembled via an adhesive.

7. The system of claim 5, wherein said joins are assembled via one or more latches.

8. The system of claim 5, wherein said joins are assembled from interlocking components.

9. The system of claim 1, wherein said closure is sealed with a sealant.

10. The system of claim 1, wherein said closure is sealed with an elastomeric resin.

11. A system for closing and insulating an access opening to a first space, said system comprising:

a generally vertical access opening, said access opening being within a wall that separates a first space from another space within a building and contacting a floor of said building;

an existing structural frame within said wall, such that the combination of said structural frame and said floor circumscribes said access opening;

a door placed within said existing structural frame for closing, but not sealing, said access opening;

a closure comprising:

a surface having a perimeter and continuous surface area larger than the perimeter and area of said access opening, said surface sized and shaped to create a seal with said existing structural frame when said closure is placed in direct contact with said existing structural frame;

a handle, said handle projecting into said access opening when said closure is in direct contact with said existing structural frame; and at least two connectors for fastening said closure to said existing structural frame;

wherein said seal between said closure and said existing structural frame substantially inhibits air from passing between said first space and said other space; and wherein said closure and said door can simultaneously close said access opening placing said handle being between said surface and said door.

12. The system of claim 11, wherein said seal between said closure and said existing structural frame substantially inhibits air from passing between said first space and said other space within a building to ensure reduction in noise transmission.

13. The system of claim 11, wherein said closure is comprised of a thermally insulating material.

14. The system of claim 11, wherein said closure is comprised of an acoustically insulating material.

15. The system of claim 14, wherein said closure is sealed with a sealant.

16. The system of claim 14, wherein said closure is sealed with an elastomeric resin.

* * * * *